US006173852B1

(12) United States Patent
Browne

(10) Patent No.: US 6,173,852 B1
(45) Date of Patent: Jan. 16, 2001

(54) CONTAINER WITH CAP HAVING CONNECTOR AND SPIKE

(75) Inventor: Martin Monteagle Browne, Oslo (NO)

(73) Assignee: Nycomed Imaging A/S, Oslo (NO)

( * ) Notice: Under 35 U.S.C. 154(b), the term of this patent shall be extended for 0 days.

(21) Appl. No.: 09/345,450

(22) Filed: Jul. 1, 1999

Related U.S. Application Data

(63) Continuation of application No. PCT/GB98/00034, filed on Jan. 7, 1998.

(30) Foreign Application Priority Data

Jan. 7, 1997 (GB) ..... 9700177

(51) Int. Cl.[7] ..... B65D 41/20

(52) U.S. Cl. ..... 215/247; 215/47; 215/DIG. 3; 215/308

(58) Field of Search ..... 604/403, 411; 215/47, 48, 247, 248, 308, 50, DIG. 3

(56) References Cited

U.S. PATENT DOCUMENTS

| | | | | |
|---|---|---|---|---|
| 2,138,936 | * | 12/1938 | Osterberg | 215/308 |
| 2,153,981 | * | 4/1939 | Heineman | 215/248 |
| 2,186,908 | * | 1/1940 | Page et al. | 215/248 |
| 2,667,986 | * | 2/1954 | Perelson | 215/247 X |
| 3,063,267 | * | 11/1962 | Shand et al. | 215/47 X |
| 3,358,865 | * | 12/1967 | Andersen | 215/DIG. 3 X |
| 4,412,623 | * | 11/1983 | Schmidt | 215/247 X |
| 4,576,602 | | 3/1986 | Levin et al. . | |
| 4,632,267 | * | 12/1986 | Fowles et al. | 215/DIG. 3 X |
| 4,747,501 | * | 5/1988 | Greaves | 215/48 X |
| 4,785,951 | * | 11/1988 | Bennett | 215/47 |
| 5,088,995 | * | 2/1992 | Packard et al. | 215/247 X |
| 5,114,030 | * | 5/1992 | Conrad | 215/DIG. 3 X |
| 5,228,593 | * | 7/1993 | O'meara | 215/48 X |
| 5,360,423 | | 11/1994 | McCormick . | |
| 5,368,177 | * | 11/1994 | Derksen | 215/247 X |
| 5,374,263 | * | 12/1994 | Weiler | 604/403 |
| 5,427,275 | | 6/1995 | Hansen . | |
| 5,590,798 | * | 1/1997 | O'Connell | 215/48 |
| 5,620,434 | * | 4/1997 | Brony | 604/403 X |
| 5,740,931 | * | 4/1998 | Weiler | 215/48 X |
| 5,772,652 | * | 6/1998 | Zielinski | 604/411 |
| 5,785,691 | * | 7/1998 | Vetter et al. | 215/DIG. 3 X |
| 5,817,082 | * | 10/1998 | Niedospial, Jr. et al. | 604/411 X |
| 5,894,949 | * | 4/1999 | Taskis et al. | 215/308 X |
| 5,895,383 | * | 4/1999 | Niedospial, Jr. | 604/403 |
| 5,902,298 | * | 5/1999 | Niedospial, Jr. et al. | 215/247 X |

FOREIGN PATENT DOCUMENTS

| | | | | |
|---|---|---|---|---|
| 0 088 056 | | 9/1983 | (EP) . | |
| 0 510 854 | | 10/1992 | (EP) . | |
| 2 017 661 | | 10/1979 | (GB) . | |
| 2252099 | * | 7/1992 | (GB) | 215/247 |
| WO 88/01881 | | 3/1988 | (WO) . | |
| WO 96/23705 | | 8/1996 | (WO) . | |

* cited by examiner

*Primary Examiner*—Stephen K. Cronin
*Assistant Examiner*—Robin A. Hylton
(74) *Attorney, Agent, or Firm*—Bacon & Thomas, PLLC

(57) ABSTRACT

A container, particularly for medical preparations, comprises a container body (2) with an integral closure portion (16) and a cap (6) provided over the closure portion. The container body is provided with a frangible portion for removal of the integral closure. The cap is provided with an internal spike (28) which penetrates the closure portion (16) when the cap (6) is screwed towards the container body (2). A Luer connector (26) is provided on the cap (6) and accesses the container contents via a passage through the spike (28).

17 Claims, 5 Drawing Sheets

CONTAINER WITH CAP HAVING CONNECTOR AND SPIKE

This application is a continuation of International Patent Application No. PCT/GB98/00034 filed Jan. 7, 1998 designating the United States of America.

BACKGROUND OF THE INVENTION

1. Field of the Invention

The present invention relates to containers and an particular to containers for sterile preparations for example for medical use.

2. Related Art

A well-known method of manufacturing containers for sterile preparations is the blow-fill-seal method in which a container is blow moulded from thermoplastics, filled with the desired preparation, which cools the thermoplastics, and then sealed. This is a convenient and inexpensive method of manufacturing such containers which has the particular advantage that the entire process may be carried out in a sterile or aseptic environment such that sterility of the container contents can be guaranteed.

A container manufactured by this method is described in EP-A-0 088 056. According to this document, the neck of the container is formed with a sealing upper section and a lower section, the two sections being connected by a frangible connection When the upper section is removed, by rupturing the frangible connection, the lower section is left in the form of a female Luer cone and may be connected to a standard male Luer connector, as commonly used in medical applications.

However, the blow moulding process used to form the container disclosed in EP-A-0 088 056 suffers from the major disadvantage that the thickness of the moulded thermoplastic cannot be consistently guaranteed. Thus, the Luer cone formed on the container cannot be guaranteed to be accurately formed, and this is an essential requirement for a Luer connection, as such a connection must form an entirely reliable seal.

WO 91/08729 discloses a similar container wherein the lower section of the neck forms a Luer lock connector. This container suffers from similar disadvantages to that of EP-A-0 088 056.

In an attempt to provide accurate connectors as part of a standard blow-fill-seal container, there have been suggested a number of containers including an insert, separately moulded from the container proper and inserted in the container before it is sealed. One such insert is disclosed in EP-A-0 685 400. An insert has the advantage that it may be moulded separately from, and therefore more accurately than, the rest of the container.

However, such inserts are generally undesirable as they complicate the manufacture of the blow-fill-seal container and in addition an insert located inside the sealed container with sterile contents must itself be sterile and this can be difficult to achieve with complete reliability.

EP-A-0 510 854 discloses a blow-fill-seal container and a cap which fits over the neck of the container. The cap has an internal needle which pierces the container as, or immediately before, the cap is placed over the container neck. The needle has a central duct which terminates externally in a receptor suitable for connection to a syringe.

U.S. Pat,. No. 5,427,275 discloses a blow-fill-seal container with a cap. The cap has an internal conical piercer which pierces the closure of the container when the cap is screwed onto the container neck. The piercer has channels formed therein which allow communication of the contents of the container with a section of the cap in the form of an external dropper, after piercing

BRIEF SUMMARY OF THE INVENTION

According to the present invention, there is provided a container comprising a container body with an integral closure portion, and a cap provided over the closure portion and having an internal spike arranged to penetrate the closure portion of the container body when the cap is moved towards the container body, the internal spike being provided with a passage for communicating the interior of the container body with the outside of the cap, the cap further having means for the connection of a syringe or similar medical device for communication with the passage, wherein the cap is removably fittable to the container body with the internal spike in a position not penetrating the closure portion, whereby the cap may be moved towards the container body to cause the internal spike to penetrate the closure portion or the cap may be removed from the container body to allow penetration of the closure portion by alternative means.

The provision of the cap enables different methods of access to the contents of the container to be provided, whilst the design of the container body can be relatively simple so that it is capable of being made by preferred methods, such as blow-fill-seal or form-fill-seal. The container is preferably supplied with the cap pre-fitted, for example to maintain a sterile region under the cap.

Thus, according to another aspect of the present invention there is provided a container comprising a container body with an integral closure portion, and a cap provided over the closure portion to maintain a sterile region under the cap.

The cap may be manufactured by a separate process, such as injection moulding, which can advantageously be a more accurate process in terms of tolerances than the process used to make the container body.

The cap is removable to expose the closure portion, for example to allow the closure portion to be penetrated by a needle or spike of a giving set or the like. Preferably, the cap is adapted to be refitted to the container body after removal, so that any remaining contents of the bottle are protected from the environment, most preferably vented to the outside via a sterile filter.

The cap may be provided with a self-sealing or resealing pierceable portion for penetration by a needle or spike, for example a thermoplastic elastomer in the external surface of the cap. A needle or spike may penetrate this portion to pierce the closure portion of the container body and access the contents of the container. When the needle or spike is removed, the resilience of the self-resealable portion closes the needle hole to reseal the container. Thus, this is one of the methods of access to the contents of the container which may be provided with an appropriately designed cap.

Alternatively, the closure portion may itself be covered by a self-sealing or resealing pierceable portion for penetration by a needle or spike. Again, this can reseal after removal of the needle or spike.

The cap is provided with a passage from its external surface to the inside of the cap, and the passage may be closed by a cover such that contamination of the closure portion by the environment is prevented.

The internal spike may be maintained sterile until it is used to penetrate the closure portion, such that there is no danger of contamination of the container contents on penetration by the spike. The walls of the passage inside the cap may form such a spike, which may be integral with the cap. The use of a penetrating spike provided on the cap gives another method of access, to the contents of the container.

The passage may be provided from the region of the tip of the spike to the outside of the cap.

The connection means may comprise a female Luer connector or a male Luer connector, or both, either of which connectors may be a Luer lock connector and/or may be vented.

The cap may be provided with separate means for the sterile venting of the container, for example a separate sterile filter, which may be provided with its own spike for penetration of the closure portion.

The cap may be provided with a branched passage communicating with the spike, or with a plurality of passages and spikes, to allow the provision of more than one connector on the same cap. Thus, a single container may allow access to its contents via plural connectors on its cap.

The cap and container body are preferably connected such that rotation of the cap results in movement of the cap towards or away from the container body. The cap may be provided with an internal screw thread or other camming means. The container body may be provided with at least one lug which cooperates with the internal screw thread or other camming means to effect the movement. Alternatively the container body may be provided with a screw thread, although this may be difficult to mould in a process such as blow-fill-seal. In the preferred embodiment, rotation of the cap can advantageously cause movement of the cap towards the container body and thus penetration of the closure portion by the spike.

As an alternative to a screw connection, the cap and container body may be provided with a slot and a cooperating projection which are arranged to prevent movement of the cap towards the container body unless the slot and projection are aligned. For example, the container body may be provided with one or more projections which locate in one or more corresponding slots in the cap to allow movement of the cap towards the container body. Alternatively one or more projections may be provided on the cap and one or more slots may be provided on the container body.

The container body may be formed with a frangible portion, for example in a neck region, which enables the removal of the integral closure portion, or a section of the container body including the integral closure portion, to allow access to the contents of the container body. The contents may then be poured out or removed with a suction tube or kwill. The frangible portion may be formed as a region of reduced wall thickness of the container body. The cap may be arranged to engage this removable section of the container body to aid in the rupture of the frangible portion. The cap may be formed to have a greater longitudinal and/or transverse extent than the removable section of the container body and thereby provide improved leverage and/or grip for the rupture of the frangible portion. Advantageously, the cap is movable between an initial position and a second position for aiding removal of the removable section. Thus, for example, in the embodiment having a rotatable cap, rotation of the cap may result in its movement away from the container body to the second position.

The cap and container body may be so arranged as to provide a sealing connection between themselves such that a region of the cap is sealed from the environment once the cap is located on the container body. The sealing may be provided by a continuous projection, for example formed integrally with the container body, around an outer surface of the container body sealingly engaging an inner surface of the cap. This projection may be deformed by the cap to seal the sterile region. Alternatively the region of the container body which engages the cap may be provided with a resilient member comprising the continuous projection, such as an O-ring or a resilient, for example elastomeric, sleeve which is trapped between the cap and the container body to form a seal. In a particularly advantageous arrangement, the resilient member encloses the closure portion of the container body so as to form a self-sealing or resealing pierceable portion for puncture by a needle or spike. For example, a sleeve of elastomeric material may be provided over the closure portion of the container body, the sleeve forming a continuous sealing projection at the periphery of its open end.

It will be appreciated from the above description that the cap may be provided with various features or combinations of features such as a self-resealing pierceable portion, a screw thread or other camming means for cooperating with the container body etc. The cap can be incorporated with these features as desired, whilst the design of the container body can advantageously be kept relatively simple. For example, the cap can be made by injection moulding, whilst the container body can be made by a blow-fill-seal process with less accurate tolerances.

DESCRIPTION OF THE DRAWINGS

Some embodiments of the invention will now be described by way of example only and with reference to the Figures, in which.

DETAILED DESCRIPTION OF PREFERRED EMBODIMENTS

Figure 2:
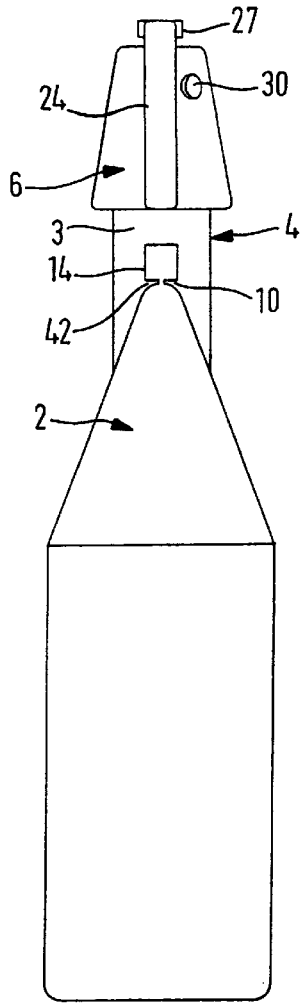
FIG. 2 is a side view of the embodiment of FIG. 1.
Figure 3:
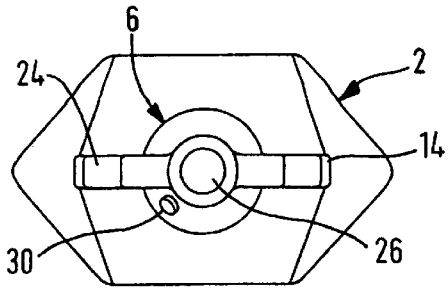
FIG. 3 is a plan view of the embodiment of FIG. 1.

A first exemplary embodiment of the invention will now be described with reference to FIGS. 1 to 3. A container body, in the form of a bottle 2 of thermoplastic material such as polypropylene, has a generally cylindrical neck 4 extending from an upper part thereof, to which is fitted a cap 6. The cross-section of the bottle 2 tapers towards the neck 4, such that the neck 4 extends from a rounded upper edge of the bottle, the upper edge forming symmetrical shoulders 10 at either side of the neck 4.

At the base of the bottle 2, a recess is formed in which is defined a hole 12, suitable for suspending the bottle 2 upside down in use. Alternatively, other means for suspending the bottle upside down may be provided, for example, a hanger label or a hinged hanger attached to the base of the bottle 2.

Extending upwardly from the shoulders 10 on each side of the neck 4 are tabs 14 which may be used with further embodiments of the invention described hereinafter.

The bottle 2, including the neck is manufactured by the blow-fill-seal method, by which the bottle is blow moulded, charged with its desired contents, which cools the thermoplastic, and then sealed. This process can be carried out in its entirety in a sterile atmosphere which makes it particularly suitable for the production and filling of containers of medical preparations. The blow-fill-seal method is well known in the art and will not be described further herein. Thus, the neck 4 is formed integrally with the bottle 2 and is sealed at its upper end by an integral closure portion in the form of a thermoplastic membrane 16. The entire bottle 2 forms a sealed continuous envelope, generally intended to contain liquid preparations for medical use.

The lower section 3 of the neck 4 of the bottle 2 is, as previously described, generally cylindrical. However, the neck 4 is profiled, such that its upper section 5 tapers to a smaller diameter than that of the lower section 3. Between the lower section 3 and the upper section 5 of the neck 4 is formed an annular recess 18 in which is provided a frangible portion 20 of the neck 4. Above the annular recess on the upper section 5 are formed two lugs 22 which project radially outwardly from the neck 4.

The cap 6 is generally frustoconical in shape and is provided with two radially outwardly extending wings 24, the outer edges of which run approximately parallel to the generatrices of the cone of the cap 6. The cap 6 is formed with a frustoconical internal cavity for receiving the neck 4. The internal wall of the cap 6 is threaded to cooperate with the lugs 22 of the neck 4. Of course, the neck 4 may also be threaded rather than having lugs 22, but the lugs are preferred, as they are easier to blow mould than a screw thread.

The internal thread of the cap 6 is so formed that anti-clockwise rotation of the cap causes it to move down the neck 4 towards the body of the bottle 2 and clockwise rotation causes it to move up the neck away from the bottle 2.

Figure 1:
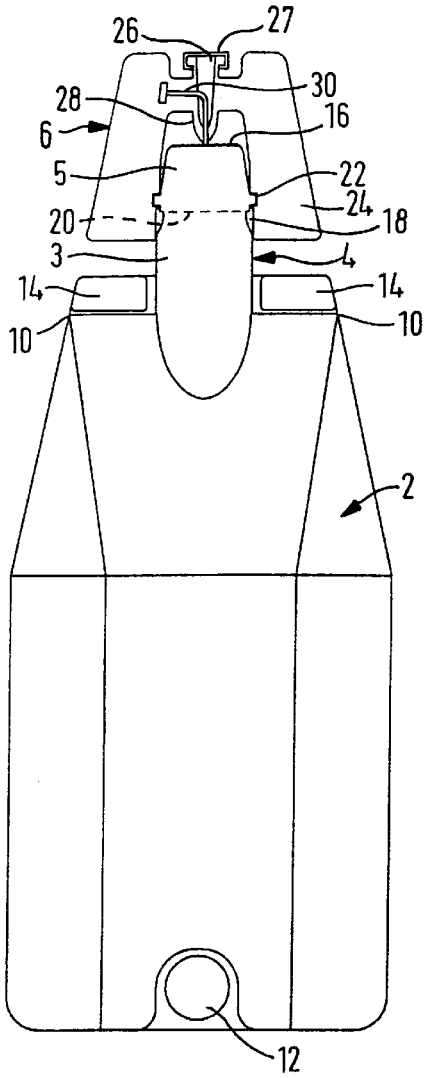
FIG. 1 is a partially sectional front view of a first embodiment of the present invention.

As shown particularly clearly in the sectional view of FIG. 1, the cap 6 is formed with a female Luer lock connector 26 in the centre of its upper face. The internal Luer cone of the Luer lock connector 26 extends from the outer upper face of the cap 6 through to the inner frustoconical cavity of the cap 6. Thus, the internal Luer cone forms a passage through the cap 6 ending in the internal cavity of the cap in a small aperture. This passage is defined in a spike 28 which projects into the internal cavity of the cap 6.

The Luer lock connector is vented by a vent 30 from the connector to the radially outer face of the cap 6. The vent is filtered to maintain sterility. During transportation or storage of the bottle 2 and cap 6 the Luer connector 26 is provided with a cover 27, again to maintain sterility.

Figure 4:
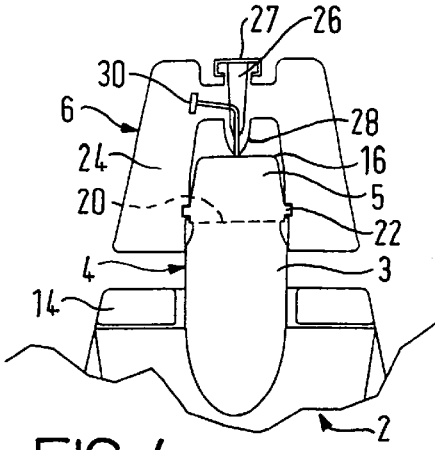
FIG. 4 is a partially sectional view of the embodiment of FIG. 1 showing a position of use of the container.

FIG. 4 is a sectional view similar to that of FIG. 1 showing the neck 4 and cap 6 in a state suitable for transportation of the container. The cap 6 is fitted to the neck 4 in the sterile atmosphere in which the blow-fill-seal process is carried out. The cap is simply screwed in an anti-clockwise direction onto the neck 4 such that the lugs 22 engage the internal thread of the cap 6. Abutment between the outer surface of the neck 4 and the inner surface of the cap 6 seals the inner cavity of the cap 6 containing the spike 28 such that this cavity, the spike 28 and membrane 16 can remain sterile even after the container is removed from the sterile atmosphere. However, this abutment is not sufficient to prevent downward movement of the cap 6 towards the body of the bottle 2, such movement simply causing a slight deformation of the neck 4.

Figure 5:
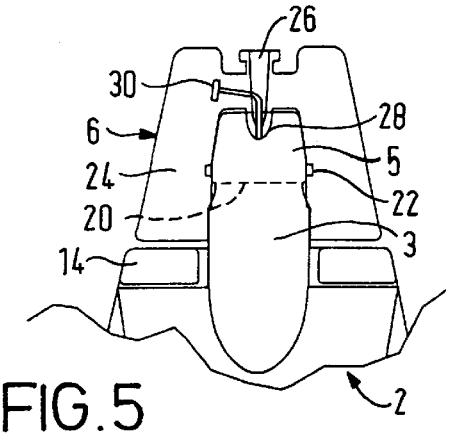
FIG. 5 is a partially sectional view of the embodiment of FIG. 1 showing a further position of use of the container.

FIG. 5 shows a sectional view of the cap 6 once it has been rotated once anti-clockwise. During rotation, the cap 6 moves downwardly towards the body of the bottle 2. This movement also progresses the spike 28 towards the membrane 16 and eventually the spike 28 pierces the membrane 16. As mentioned above, the spike 28 and membrane 16 may both be maintained in a sterile condition such that there is no danger of any contamination of the contents of the bottle 2 when the cap membrane 16 is pierced by the spike 28.

The Luer cone of the Luer connector 26 now forms a passage through which the contents of the bottle may be drawn. Thus, the bottle 2 may now be connected to a male Luer connector, for example of a syringe, and the contents of the bottle may be aseptically transferred thereto.

Figure 6:
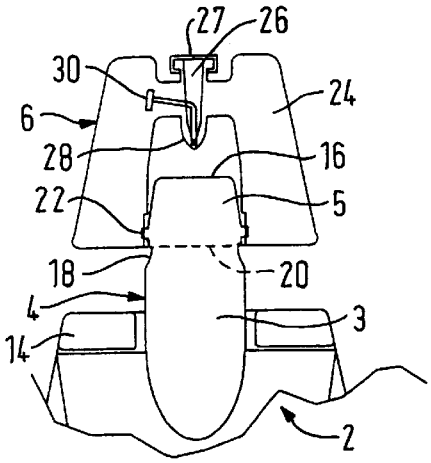
FIG. 6 is a partially sectional view of the embodiment of FIG. 1 showing yet a further position of use of the container.
Figure 7:
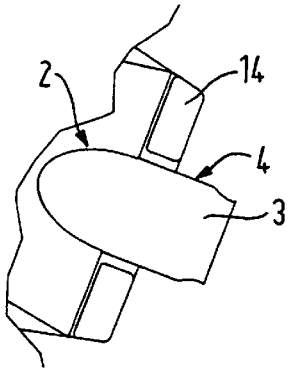
FIG. 7 is a view of the embodiment of FIG. 1 after removal of the upper section of the container neck.
Figure 8:
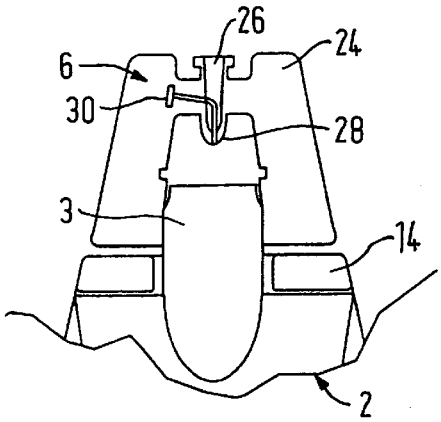
FIG. 8 is a partially sectional view of the embodiment of FIG. 1 showing a position of use of the container.

FIG. 6 shows the situation when the cap 6 has been turned once clockwise from the position of FIG. 4. As can be seen, the cap 6 has travelled up the neck 4 away from the body of the bottle 2 such that the lower edge of the cap 6 is aligned with the frangible portion 20 of the neck 4. In this position the cap 6 acts as a grip and lever for a user who may pull the cap, preferably to one side, such that the engagement between the lugs 22 and the inner thread of the cap 6 transmits the force exerted by the user to the frangible portion 20 of the neck 4, which frangible portion 20 ruptures allowing the upper section 5 of the neck to be removed. Once the upper section 5 of the neck has been removed the contents of the bottle 2 may be poured out of the bottle 2 as shown in FIG. 7. Alternatively, a tube or kwill may be inserted into the opened bottle 2 and the contents may be drawn out by a suitable suction device. If desired, the cap 6 may be replaced on the lower section 3 of the neck 4 to protect any remaining contents of the bottle 2, as shown in FIG. 8.

It will be noted that, when the cap 6 is in the position shown in FIG. 4, a transverse force applied to the cap 6 will not cause rupturing of the frangible portion 20, as such a force will tend to cause the lower inner edge of the cap 6 to abut against the outer surface of the neck 4 preventing any movement of the upper section 5 of the neck relative to the lower section 3 thereof. In the position of the cap 6 shown in FIG. 6, the lower inner edge of the cap 6 is able to move into the annular recess 18 when a transverse force is applied to the upper end of the cap, thereby aiding rupture of the frangible portion 20.

Figure 9:
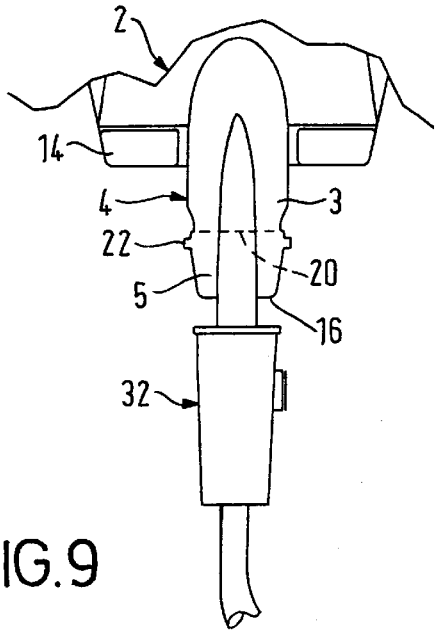
FIG. 9 is a view of the container of FIG. 1 connected to a giving set.

FIG. 9 shows the situation when the cap 6 has been completely removed from the neck 4 by rotating the cap 6 clockwise. A spike of a giving set 32 may then pierce the membrane 16 to dispense the contents of the bottle in a conventional manner.

Thus, the cap 6 of the embodiment of FIGS. 1 to 9, allows the contents of the container to be dispensed in four different ways:

by piercing the membrane 16 with the spike 28 and connecting a suitable device to the Luer connector 26;

by rupture of the frangible portion 20 and pouring of the contents;

by rupture of the frangible portion 20 and suction of the contents from the bottle with a kwill or straw; or by piercing of the membrane 16 with a separate spike or needle in a conventional manner.

As an alternative to the female Luer lock connector 26 the connector at the centre of the upper face of the cap 6 may be formed as a male Luer lock connector. Indeed, the male or female connector may be a simple Luer cone, i.e. a non-locking Luer connector, or any other suitable standard connection. The vent 30 is an optional feature and may be omitted from the cap to provide an unvented Luer connection.

The Luer connector 26 and spike 28 may, in an adaptation of this embodiment, be accompanied by a thermoplastic elastomer membrane (not shown). In this case, a sterilised syringe needle pierces the elastomer membrane and subsequently the membrane 16 of the neck 4 so that the contents of the bottle 2 may be drawn into the syringe. Once the needle is withdrawn, the elastomer membrane acts to reseal the cap 6. As the inner cavity of the cap 6 may be sealed in a sterile condition, there is no danger of the syringe needle becoming contaminated as it enters the bottle 2. In this way, the blow-fill-seal bottle 2 may be provided with a self-sealing thermoplastic elastomer membrane without complicating the manufacture of the container itself.

Figure 10:
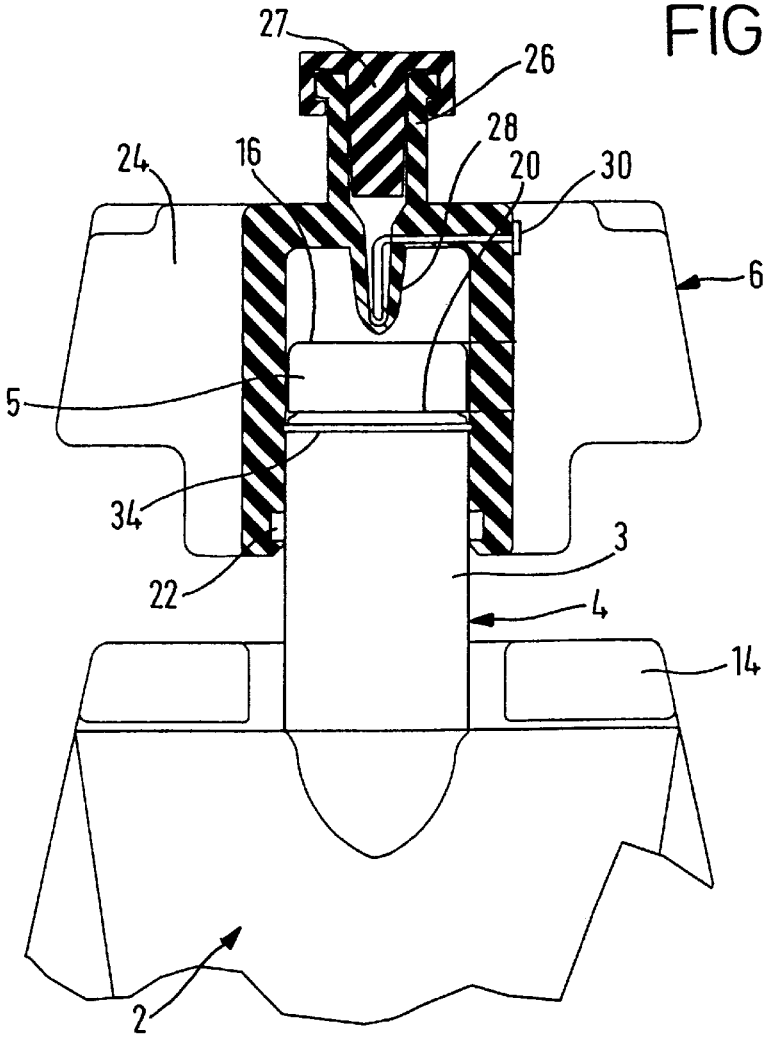
FIG. 10 is a partially sectional front view of a second embodiment of the present invention.

FIG. 10 shows an alternative embodiment of the cap 6 and neck 4. In this case, the upper section 5 of the neck 4 is not tapered but is cylindrical and has a slightly smaller diameter than the lower section 3. The annular recess 18 between the upper and lower regions 5, 3 again contains a frangible portion 20. Below the annular recess 20, a seal 34 is integrally moulded with the neck 4 to form a radially outwardly projecting annular rib. When the cap 6 is fitted to the neck 4, the seal 34 is deformed by the inner walls of the cap 6, which in this embodiment is cylindrical rather than frustoconical, such that the inner cavity of the cap 6, housing the spike 28 and the membrane 16 is sealed in a sterile condition. The reduced diameter of the upper section 5 of the neck 4 ensures that the cap 6 may be applied and removed without frictionally engaging the upper section 5 which engagement may cause rupturing of the frangible portion 20. In this embodiment, the lugs 22 are located below the frangible portion 20. The cap 6 may nevertheless be used to aid removal of the upper section 5 of the neck 4, as it provides an extension of the upper section 5. Thus, when the cap is raised such that its lower edge is higher than the level of the frangible portion 20, but the cap is still in engagement with the upper section 5 of the neck, the cap may be used as a tool which improves the grip and leverage available to the user when rupturing the frangible portion 20.

Operation of the embodiment of FIG. 10 is otherwise equivalent to that of FIGS. 1 to 9 and thus will not be described further herein.

Figure 11:
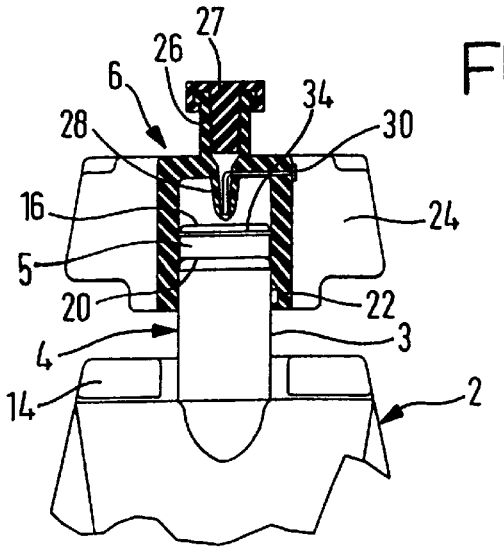
FIG. 11 is a partially sectional front view of an alternative arrangement of the embodiment of FIG. 10.

FIG. 11 shows an alternative position of the seal in an embodiment similar to that of FIG. 10. In this case, the seal 34 is formed around an end region of the upper section 5 of the neck 4.

As an alternative to the annular seal 34, a rubber thermoplastic elastomer sleeve may be located between the inner surface of the cap 6 and the outer surface of the neck 4 to seal the inner cavity of the cap 6 and maintain the sterility of the spike 28 and the membrane 16.

Figure 12:
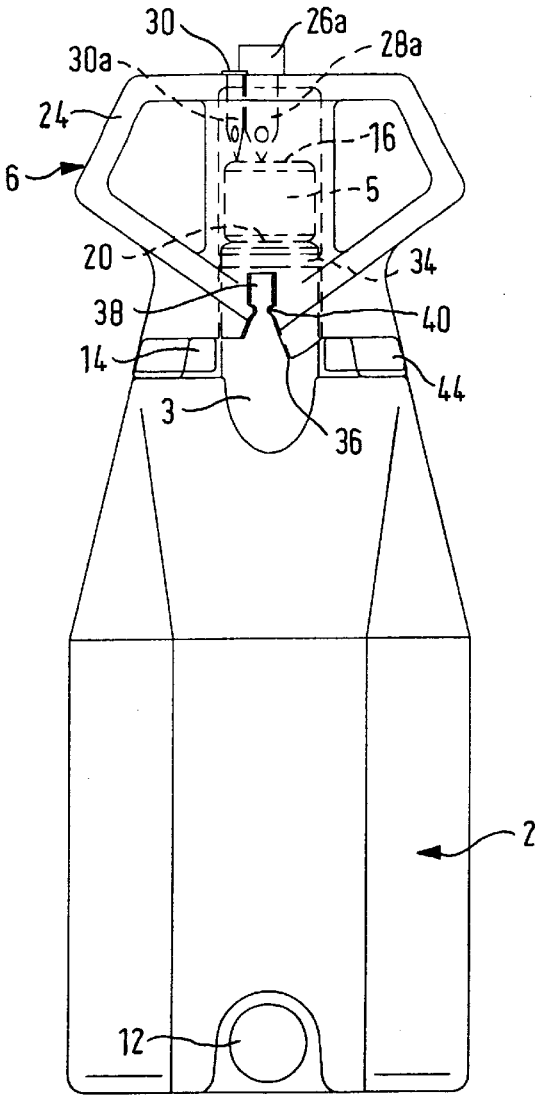
FIG. 12 is a partially sectional front view of a third embodiment of the present invention.
Figure 13:
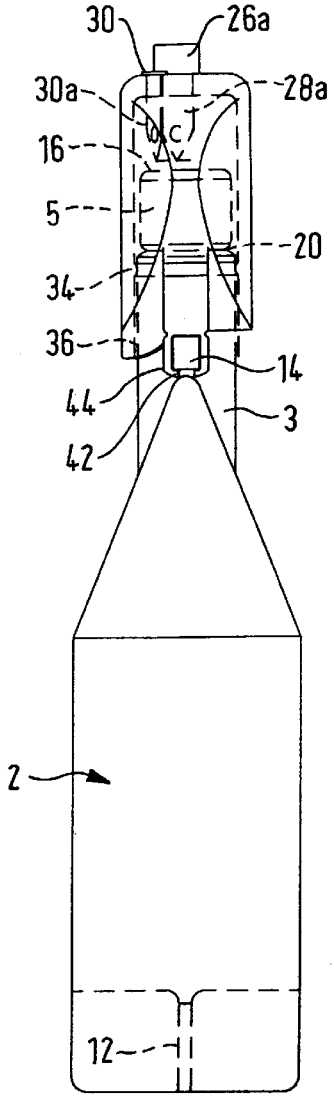
FIG. 13 is a side view of the embodiment of FIG. 12.
Figure 14:
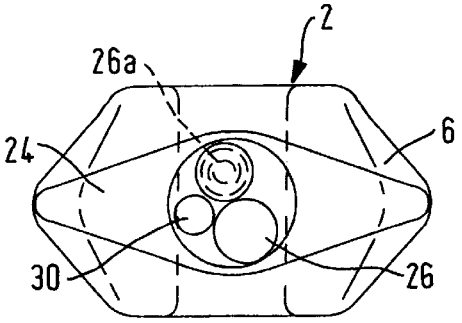
FIG. 14 is a plan view of the embodiment of FIG. 12.

FIGS. 12 to 14 show a further embodiment of the present invention. The bottle 2 and neck 4 of this embodiment are similar to those of the embodiment of FIG. 10. However, in this embodiment, the neck 4 is not provided with lugs 22 and the cap 6 has no corresponding internal thread. Instead, the lower annular edge of the cap 6 is profiled and has formed thereon two corresponding projections 36 each of which projects downwardly at opposite sides of the neck 4 such that, on clockwise rotation of the cap 6, the leading edge of each projection 36 engages a respective tab 14 of the bottle 2. The engagement between the projections 36 and the tabs 14 causes further clockwise rotational movement to cam the entire cap 6 upwardly, thereby aiding removal of the cap 6.

The trailing edge of the projections 36 is formed such that on anti-clockwise rotation of the cap 6, this edge abuts against the tab 14 to prevent further rotation in that direction. Adjacent the trailing edge of each projection 36, a vertical slot 38 is formed in the cap 6. The slot 38 has an upwardly tapering mouth leading to the slot proper. At the entrance to the slot proper, two teeth 40 are formed. When the trailing edges of each projection 36 abut against the tabs 14 the mouth of each slot 38 is located above the tabs 14. At this point it is possible to push down on the cap 6 such that the cap moves towards the body of the bottle 2 and the tabs 14 locate in the slots 38. At the same time the spike 28 pierces the membrane 16. The teeth 40 engage in recesses 42 defined between the tabs 14 and the shoulders 10 of the bottle 2. The engagement of the teeth 40 in the recesses 42 maintains the cap in the down position.

Because downward movement of the cap 6 is achieved in this case by a single downward push rather than by the screw threads of the embodiment of FIGS. 1 to 11, the spike 28 of this embodiment may be located off-centre with respect to the axis of the cap 6. Furthermore, this allows for more than one connector to be located in the upper face of the cap 6. As shown clearly in FIG. 14, in the present embodiment the cap 6 is provided with both male 26*a* and female 26 Luer connectors having respective spikes 28, 28*a*. A filtered vent 30 is also provided in the cap 6 and has associated with it, a further spike 30*a*.

The cap 6 of this embodiment is provided with tamper tags 44 extending from the lower edge of the cap 6. In the transport position, shown in FIGS. 12 and 13 the tags 44 engage around the tabs 14 and an angled portion at the end of each tag locates in the recesses 42 between the tabs 14 and the shoulders 10 of the bottle 2. In this way, the cap 6 is held on the neck 4 during transit by the engagement of the angled portions in the recesses 42, but once the cap is rotated the angled portions snap out of the recesses 42 and the tags 44 are broken making any opening and potential contamination of the container evident.

Figure 15:
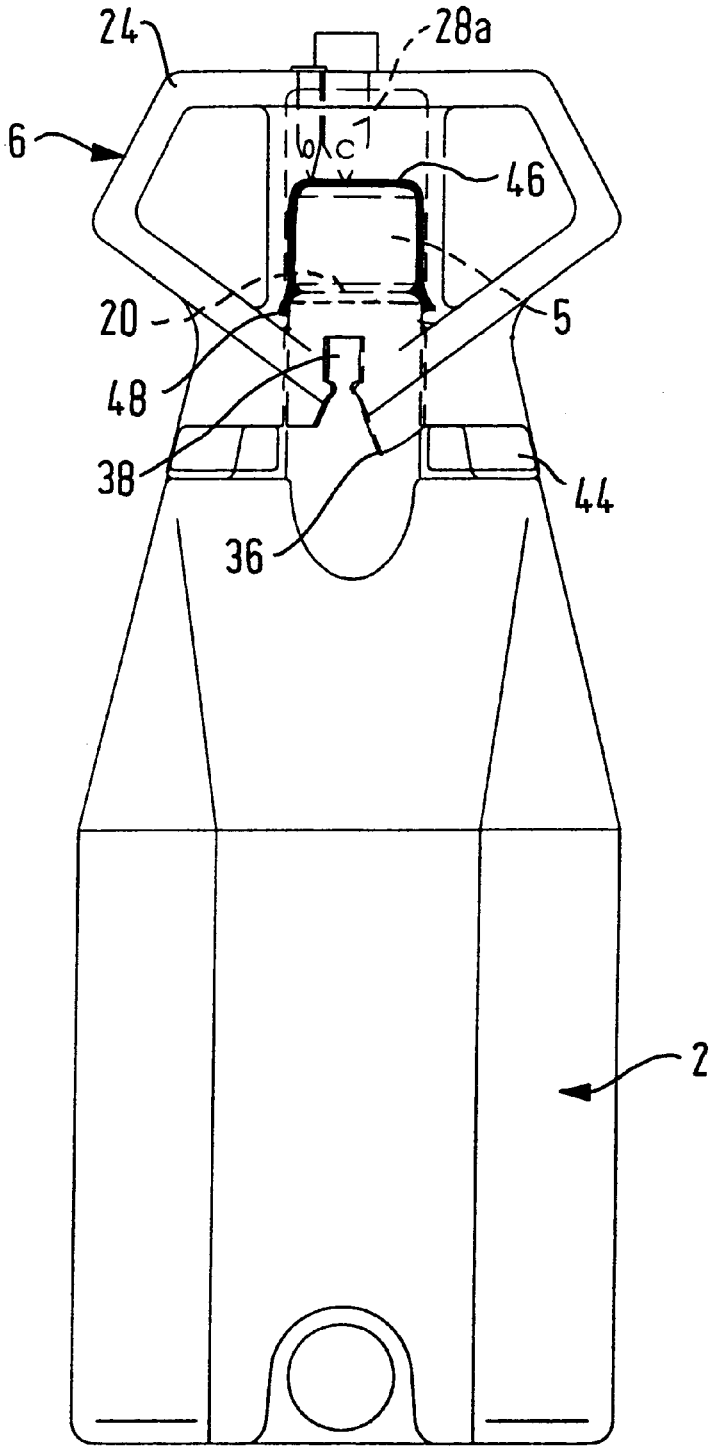
FIG. 15 is a partially sectional front view of an alternative arrangement of the embodiment of FIGS. 12 to 14.

FIG. 15 shows an alternative arrangement of the embodiment of FIGS. 12 to 14 in which the upper section 5 of the neck 4 is provided with a thermoplastic elastomer sleeve 46. The sleeve 46 encloses the entire upper section 5 of the neck including the membrane 16 and is enlarged at its lower periphery to form a sealing lip 48 between the neck 4 and the inner surface of the cap 6. The sleeve 46 provides a convenient seal 48 between the neck 4 and the cap 6 which can maintain the sterility of the spike 28*a* and the rest of the sleeve 46. In addition, when the cap 6 is completely removed from the neck 4, the contents of the bottle 2 may be accessed by puncturing the membrane 16, and the elastomer sleeve 46, with a needle or spike. In this case, the upper surface of the elastomer sleeve 46 acts to reseal the membrane 16 after the needle or spike has been removed.

I claim:

1. A container comprising a container body with an integral closure portion, and a cap provided over the closure portion and having an internal spike arranged to penetrate the closure portion of the container body when the cap is moved towards the container body, the internal spike being provided with a passage for communicating the interior of the container body with the outside of the cap, the cap further having means for the connection of a syringe or similar medical device for communication with the passage, wherein the cap is removably fittable to the container body with the internal spike in a position not penetrating the closure portion, such that the cap selectively may be moved towards the container body to cause the internal spike to penetrate the closure portion or the cap selectively may be removed from the container body to allow penetration of the closure portion by alternative means, and wherein said container body is provided with a frangible portion for removal of said integral closure portion.

2. A container as claimed in claim 1, wherein the cap and container body are connected such that rotation of the cap results in movement of the cap towards or away from the container body.

3. A container as claimed in claim 2, wherein the cap is provided with an internal screw thread.

4. A container as claimed in claim 3, wherein the container body is provided with at least one lug which cooperates with said internal screw thread to effect said movement.

5. A container as claimed in claim 1, wherein the cap and container body are provided with a slot and a cooperating projection which are arranged to prevent movement of the cap towards the container body unless the slot and projection are aligned.

6. A container as claimed in claim 1, further comprising a continuous projection around an outer surface of the container body sealingly engaging an inner surface of the cap.

7. A container as claimed in claim 6, wherein the projection is formed integrally with the container body.

8. A container as claimed in claim 1, wherein the closure portion is covered by a self-sealing or resealing pierceable portion for penetration by a needle or spike.

9. A container as claimed in claim 6, wherein the closure portion is covered by a self-sealing or resealing pierceable portion for penetration by a needle or spike and wherein the self-sealing or resealing pierceable portion is formed as part of a member comprising the continuous projection.

10. A container as claimed in claim 1, wherein the cap is provided with means for the sterile venting of the container.

11. A container as claimed in claim 1, wherein said connection means comprises a female Luer connector.

12. A container as claimed in claim 1, wherein said connection means comprises a male Luer connector projecting outwardly from the cap.

13. A container as claimed in claim 11 or 12, wherein the Luer connector is a lock connector.

14. A container as claimed in claim 11, wherein the Luer connector is vented.

15. A container as claimed in claim 1, wherein the cap is engageable with the container body to aid rupture of the frangible portion.

16. A container as claimed in claim 1, wherein the cap is adapted to be refitted to the container body after removal.

17. A container as claimed in 1, wherein the cap provided over the closure portion defines a sterile region under the cap.

* * * * *